US011986708B2

(12) United States Patent
Yamamoto

(10) Patent No.: US 11,986,708 B2
(45) **Date of Patent: *May 21, 2024**

(54) GOLF CLUB HEAD AND MANUFACTURING METHOD FOR SAME

(71) Applicant: Sumitomo Rubber Industries, Ltd., Kobe (JP)

(72) Inventor: Akio Yamamoto, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/016,683

(22) Filed: Sep. 10, 2020

(65) Prior Publication Data

US 2021/0038954 A1 Feb. 11, 2021

Related U.S. Application Data

(63) Continuation of application No. 15/976,531, filed on May 10, 2018, now Pat. No. 10,799,774, which is a (Continued)

(30) Foreign Application Priority Data

Jan. 31, 2013 (JP) ..... 2013-017516

(51) Int. Cl.
*A63B 53/04* (2015.01)
*B22D 19/00* (2006.01)
(Continued)

(52) U.S. Cl.
CPC ..... *A63B 53/0466* (2013.01); *A63B 53/0454* (2020.08); *B22D 19/00* (2013.01);
(Continued)

(58) Field of Classification Search
CPC ..... A63B 53/0466; A63B 53/0454; A63B 53/045; A63B 53/0408; A63B 53/0437; A63B 53/0412
See application file for complete search history.

(56) References Cited

U.S. PATENT DOCUMENTS 6,634,958 B1 * 10/2003 Kusumoto ..... A63B 60/00 473/310
7,338,390 B2 * 3/2008 Lindsay ..... A63B 60/02 473/335
7,491,134 B2 2/2009 Murphy et al.
7,828,676 B2 * 11/2010 Wada ..... A63B 53/0466 473/346

(Continued)

FOREIGN PATENT DOCUMENTS

JP 2005312942 * 10/2005 ..... A63B 53/0466
JP 2005-312942 A 11/2005

OTHER PUBLICATIONS

U.S. Appl. No. 14/168,799, filed Jan. 30, 2014.
U.S. Appl. No. 15/218,746, filed Jul. 25, 2016.
U.S. Appl. No. 15/976,531, filed May 10, 2018.

*Primary Examiner* — Michael D Dennis
(74) *Attorney, Agent, or Firm* — Birch, Stewart, Kolasch & Birch, LLP

(57) ABSTRACT

A method of manufacturing a golf club head enables increased moment-of-inertia and improved durability. The golf club head's crown portion has a first region having a first thickness and multiple second regions having a second thickness that is smaller than the first thickness. The second regions are distributed in a radiating fashion so as to extend from an origin toward a peripheral portion of the crown portion excluding the face side, the origin being located within 15 mm of the center of gravity of the golf club head in the toe-heel direction and also being located in the vicinity of the face side in the face-back direction in a plan view.

7 Claims, 9 Drawing Sheets

Related U.S. Application Data continuation of application No. 15/218,746, filed on Jul. 25, 2016, now Pat. No. 9,981,164, which is a continuation of application No. 14/168,799, filed on Jan. 30, 2014, now Pat. No. 9,421,430.

(51) Int. Cl.

| | |
|---|---|
| ***B22D 19/04*** | (2006.01) |
| ***B22D 21/00*** | (2006.01) |
| ***B22D 25/02*** | (2006.01) |
| ***C22C 14/00*** | (2006.01) |

(52) U.S. Cl.

CPC ..... *B22D 19/04* (2013.01); *B22D 21/005* (2013.01); *B22D 25/02* (2013.01); *C22C 14/00* (2013.01); *A63B 53/0408* (2020.08); *A63B 53/0412* (2020.08); *A63B 53/0437* (2020.08); *A63B 53/045* (2020.08)

(56) References Cited

U.S. PATENT DOCUMENTS

| | | | | |
|---|---|---|---|---|
| 9,421,430 | B2 | 8/2016 | Yamamoto | |
| 9,981,164 | B2 | 5/2018 | Yamamoto | |
| 10,155,138 | B2 | 12/2018 | Mizutani | |
| 2002/0019266 | A1* | 2/2002 | Yabu ..... | A63B 53/0466 473/345 |
| 2008/0132356 | A1* | 6/2008 | Chao ..... | A63B 53/0466 473/345 |
| 2009/0305814 | A1* | 12/2009 | Jertson ..... | A63B 53/0466 473/409 |
| 2010/0120554 | A1* | 5/2010 | Yu ..... | A63B 53/0466 473/345 |
| 2011/0183776 | A1* | 7/2011 | Breier ..... | A63B 53/0466 473/345 |
| 2011/0287859 | A1* | 11/2011 | Jertson ..... | A63B 53/0466 473/346 |
| 2012/0021849 | A1 | 1/2012 | Gibbs et al. | |

* cited by examiner

Cross-section along E1

GOLF CLUB HEAD AND MANUFACTURING METHOD FOR SAME

This application is a Continuation of co-pending U.S. application Ser. No. 15/976,531 filed on May 10, 2018, which is a Continuation of U.S. application Ser. No. 15/218,746 filed on Jul. 25, 2016 (now U.S. Pat. No. 9,981,164), which is a Continuation of U.S. application Ser. No. 14/168,799 filed on Jan. 30, 2014 (now U.S. Pat. No. 9,421,430), which claims the benefit of Japanese Patent Application No. 2013-017516 filed on Jan. 31, 2013. The entire contents of all of the above applications are hereby incorporated by reference.

TECHNICAL FIELD

The present invention relates to a golf club head and a manufacturing method for the same.

BACKGROUND ART

The heads of wood golf clubs have conventionally undergone many improvements, and in particular, various proposals have been made for a reduction in the weight of the crown portion. For example, with the golf club head disclosed in Patent Literature 1, the weight of the crown portion is reduced by forming multiple regions having a small thickness in the crown portion.

CITATION LIST

Patent Literature

Patent Literature 1: JP 2005-312942A

SUMMARY OF INVENTION

Technical Problem

However, reducing the thickness of the crown portion has the problem of a reduction in the durability of the golf club head. Specifically, the crown portion is subjected to high impact when a ball is hit with a club, and damage such as cracking can possibly occur if the thickness of the crown portion is reduced. Also, there is the problem that it is difficult to maintain durability while reducing the weight of the crown portion, as well as effectively increase the horizontal moment of inertia (moment of inertia about a vertical axis that passes through the center of gravity of the golf club head) without increasing the weight of the golf club head. The present invention has been achieved in order to solve the above-described problems, and an object thereof is to provide a golf club head that enables increasing the moment of inertia while also improving durability, and a manufacturing method for the same.

Solution to Problem

A golf club head according to the present invention is a golf club head including a crown portion, wherein the crown portion has a first region having a first thickness and a plurality of second regions having a second thickness that is smaller than the first thickness, the plurality of second regions are distributed in a radiating fashion so as to extend from an origin toward a peripheral portion of the crown portion excluding a face side, the origin being located within 15 mm of the center of gravity of the golf club head in a toe-heel direction and also being located in the vicinity of the face side in a face-back direction in a plan view, a portion of the first region arranged between adjacent second regions is configured such that the width of the first region portion increases as the first region portion extends from the origin side to the peripheral portion side, the peripheral portion of the crown portion is configured by the first region, and edges of the second regions on the peripheral portion side are connected to the peripheral portion configured by the first region.

In the above golf club head, a transition portion in which the thickness changes between the first thickness and the second thickness may be provided between the first region and the second regions, and the width of the transition portion may be in a range of 0.5 to 10 mm.

In any of the above golf club heads, the width of the first region portion arranged between adjacent second regions may be in a range of 1 to 8 mm in an end portion on the origin side, and be in a range of 5 to 20 mm in an end portion on the peripheral portion side.

In any of the above golf club heads, the crown portion may be formed from a titanium alloy, and the first thickness may be in a range of 0.5 to 0.8 mm, and the second thickness may be in a range of 0.2 to 0.6 mm.

In any of the above golf club heads, the crown portion may be formed from stainless steel or maraging steel, and the first thickness may be in a range of 0.8 to 1.5 mm, and the second thickness may be in a range of 0.5 to 1.3 mm.

In any of the above golf club heads, the second regions may be configured such that the width of each second region increases as the second region extends from the origin side to the peripheral portion side.

A manufacturing method for a golf club head according to the present invention includes: a step of preparing a mold for a golf club head that has a crown portion, the crown portion having a first region having a first thickness and a plurality of second regions having a second thickness that is smaller than the first thickness, the plurality of second regions being distributed in a radiating fashion so as to extend from an origin toward a peripheral portion of the crown portion excluding a face side, the origin being located within 15 mm of the center of gravity of the golf club head in a toe-heel direction and also being located in the vicinity of the face side in a face-back direction in a plan view, a portion of the first region arranged between adjacent second regions being configured such that the width of the first region portion increases as the first region portion extends from the origin side to the peripheral portion side, the peripheral portion of the crown portion being configured by the first region, and edges of the second regions on the peripheral portion side being connected to the peripheral portion configured by the first region; and a step of injecting molten metal through at least one gate provided in the mold, the gate being provided at a position that corresponds to the first region in the peripheral portion of the crown portion.

Advantageous Effects of Invention

The present invention enables increasing the moment of inertia while also improving durability.

REFERENCE SIGNS LIST

Figure 1:
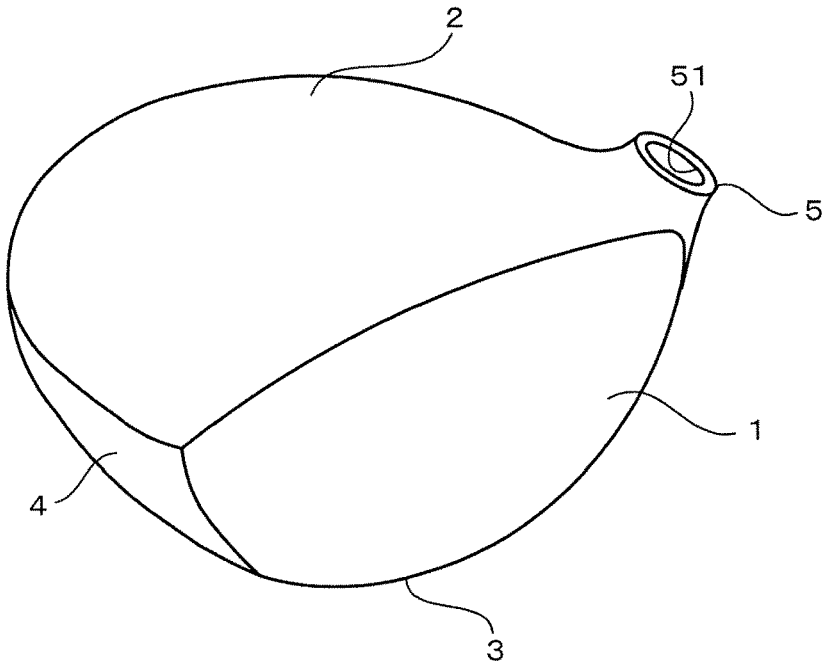
FIG. 1 is a perspective view of a reference state of a golf club head according to an embodiment.

1 Face portion
2 Crown portion
21 First region
22 Second region
23 Peripheral portion
24 Transition portion
4 Side portion

DESCRIPTION OF EMBODIMENTS

Figure 2:
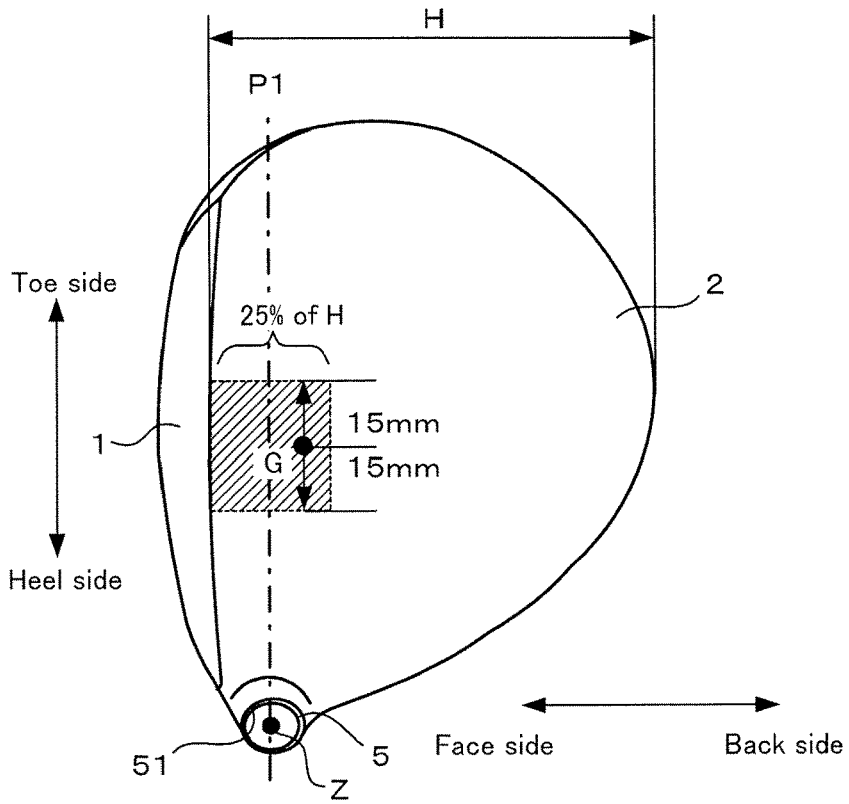
FIG. 2 is a plan view of FIG. 1.

An embodiment of a golf club head according to the present invention will be described below with reference to the drawings. FIG. 1 is a perspective view of a reference state of the golf club head of the present embodiment, and FIG. 2 is a plan view of FIG. 1. Note that the reference state of the golf club head will be described later.

As shown in FIG. 1, the golf club head of the present embodiment (hereinafter sometimes simply referred to as the "head") is a hollow structure and has wall surfaces formed by a face portion 1, a crown portion 2, a sole portion 3, a side portion 4, and a hosel portion 5.

The face portion 1 has a face surface, which is the surface for hitting a ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the portion between the crown portion 2 and the sole portion 3, and extends from the toe side of the face portion 1, across the back side of the head, to the heel side of the face portion 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft. Although the head described here is a wood head such as a driver (#1) or fairway wood head, it is not limited to being a wood head, and may be a so-called utility head, hybrid head, or the like.

The following describes the aforementioned reference state. First, as shown in FIGS. 1 and 2, the reference state is defined as a state in which the central axis Z is in a plane P1 that is perpendicular to a horizontal plane H0 (FIG. 5), and furthermore the head is placed on the horizontal plane H0 at a predetermined lie angle and real loft angle. The plane P1 will be referred to as the reference vertical plane P1. Also, as shown in FIG. 2, the direction of the line of intersection of the reference vertical plane P1 and the horizontal plane H0 will be referred to as the toe-heel direction, and the direction that is perpendicular to the toe-heel direction and parallel to the horizontal plane H0 will be referred to as the face-back direction.

Figure 3A:
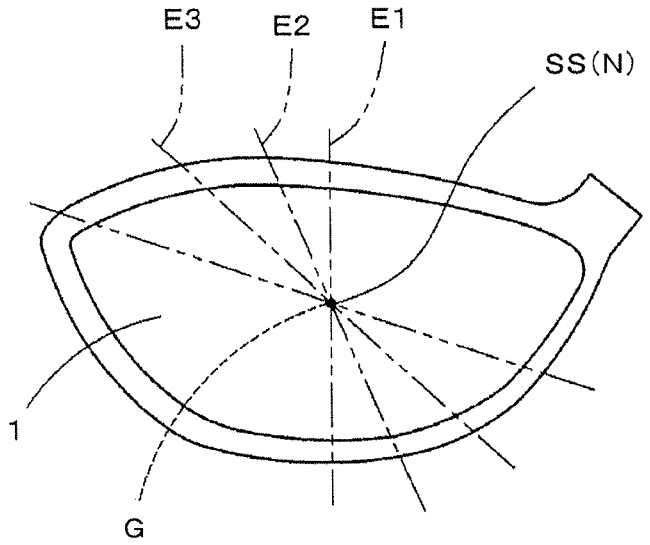
FIGS. 3A and 3B are diagrams illustrating the boundary of a face portion.
Figure 3B:
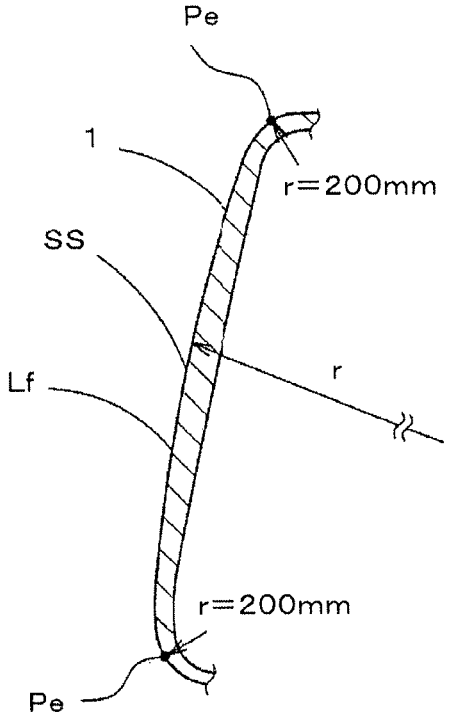

In the present embodiment, the boundary between the crown portion 2 and the side portion 4 can be defined as follows. Specifically, if a ridge line is formed between the crown portion 2 and the side portion 4, that ridge line serves as the boundary. On the other hand, if a clear ridge line is not formed, the boundary is the outline that is seen when the head is placed in the reference state and viewed from directly above the center of gravity of the head. Similarly, in the case of the boundary between the crown portion 2 and the face portion 1 as well, if a ridge line is formed, that ridge line serves as the boundary. However, if a clear ridge line is not formed, the periphery (boundary) of the face portion 1 is defined by positions Pe where, in cross-sections E1, E2, E3, and so on that include a straight line N connecting a head center of gravity G and a sweet spot SS as shown in FIG. 3A, a radius of curvature r of an outline Lf of the outer surface of the face first reaches 200 mm when extending outward from the sweet spot side as shown in FIG. 3B. Note that the sweet spot SS is the point where the normal line (straight line N) of the face surface that passes through the head center of gravity G intersects the face surface.

The volume of this golf club head is, for example, preferably 300 $cm^3$ or more, more preferably 400 $cm^3$ or more, and particularly preferably 420 $cm^3$ or more. Having such a volume is advantageous for the head in terms of increasing comfort when the club is held and also increasing the sweet spot area and the moment of inertia. Note that although an upper limit is not particularly defined for the head volume, practically it is, for example, desirably 500 $cm^3$ or less, or desirably 470 $cm^3$ or less when complying with R&A or USGA rules and regulations.

Also, the head can be formed from a titanium alloy having a specific gravity of approximately 4.4 to 4.5 (Ti-6Al-4V), for example. Besides a titanium alloy, the head can be formed from one or two or more materials selected from among stainless steel, maraging steel, an aluminum alloy, a magnesium alloy, an amorphous alloy, and the like.

Note that the head of the present embodiment is constituted by combining a head body that has at least the crown portion 2 with another portion. For example, a configuration is possible in which only the face portion 1 is constituted by another member, and the head is constituted by attaching the face portion 1 to the head body, and it is also possible to form a head body in which an opening is provided in the sole portion 3 and the side portion 4, and to block the opening with another member.

Figure 4:
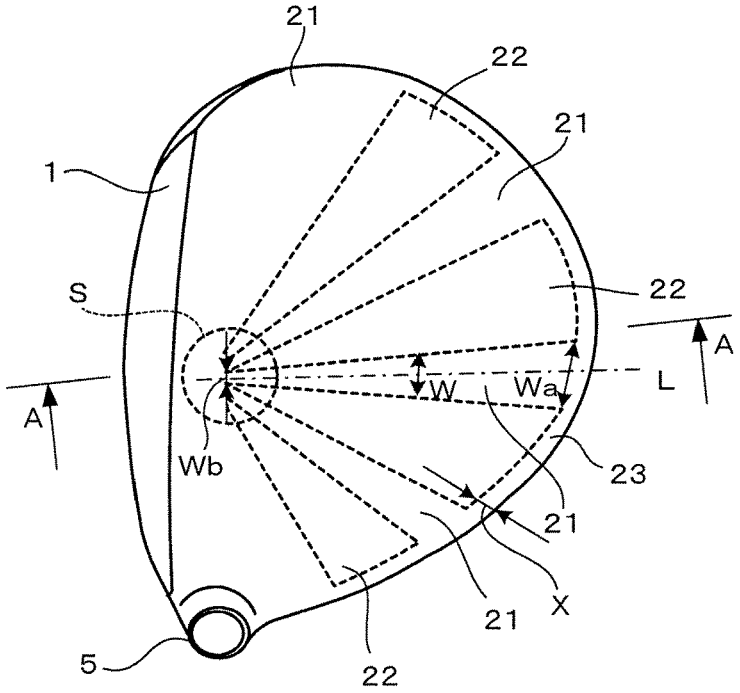
FIG. 4 is a plan view of the golf club head shown in FIG. 1.
Figure 5:
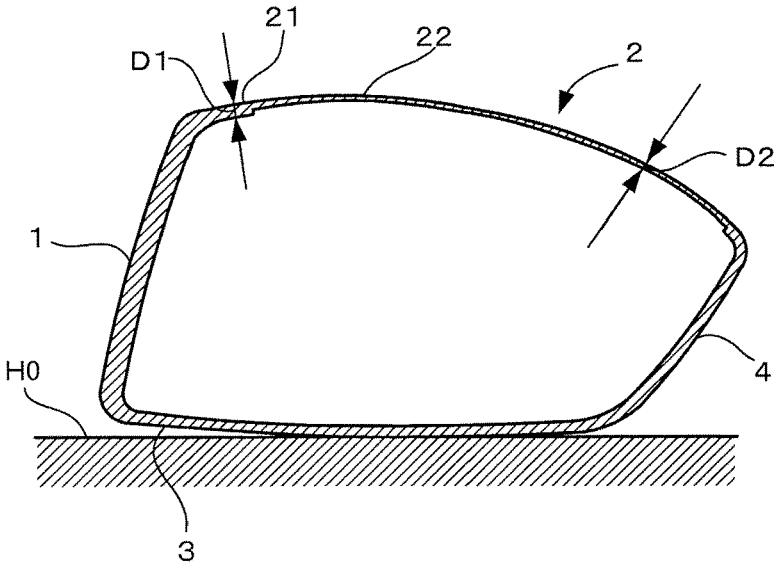
FIG. 5 is a cross-sectional view taken along A-A in FIG. 4.

Next, the crown portion 2 will be described with reference to FIGS. 4 and 5 as well. FIG. 4 is a plan view of the golf club head, and in particular, regions having a different thickness (later-described second regions) in the crown portion 2 are indicated with broken lines. Also, FIG. 5 is a cross-sectional view taken along A-A in FIG. 4. As shown in FIGS. 4 and 5, the crown portion 2 is constituted by a first region 21 that has a large thickness and multiple (four in the present embodiment) second regions 22 that have a small thickness. As shown in FIG. 5, the second regions 22 have a reduced thickness due to being formed as recessed portions in the inner wall surface of the crown portion 2. The second regions 22 are distributed in a radiating fashion so as to extend from an origin S toward the peripheral portion 23 of the crown portion 2 excluding the face side, the origin S being located within 15 mm of the center of gravity G of the golf club head in the toe-heel direction and also being located in the vicinity of the face side in the face-back direction in a plan view.

Note that as shown in FIG. 2, in terms of the toe-heel direction, the position where the origin S is arranged is within 15 mm of the center of gravity G of the head on the toe side and within 15 mm of the center of gravity G of the head on the heel side, thus being in a total range of 30 mm, as described above. Meanwhile, in terms of the face-back direction, on the back side of the boundary between the face portion 1 and the crown portion 2, the origin S need only be located within 25% of the length H of the crown portion 2 in the face-back direction from this boundary. As shown in FIG. 2, in a plan view in the reference state, the length H in the face-back direction is the distance between the point on the crown portion 2 that is located most toward the back side and the point on the boundary between the crown portion 2 and the face portion 1 that is located most toward the face side. Accordingly, the origin S is arranged in the region indicted by hatching in FIG. 2. Furthermore, the phrase "in a radiating fashion" need only be an aspect in which the second regions 22 extend from the origin S toward the peripheral portion side of the crown portion 2 at predetermined angles, and it is sufficient that at least the second regions are not aligned parallel to each other. Note that the phrase "the peripheral portion 23 of the crown portion 2 excluding the face side" refers to the portion of the peripheral portion of the crown portion 2 that excludes the portions joined to the face portion 1. Also, there is no need for the number of origins S to be one, and there may be multiple origins S in the above-described region. In other words, an aspect is possible in which a portion of the second regions 22 extend in a radiating fashion from different origins.

Figure 6:
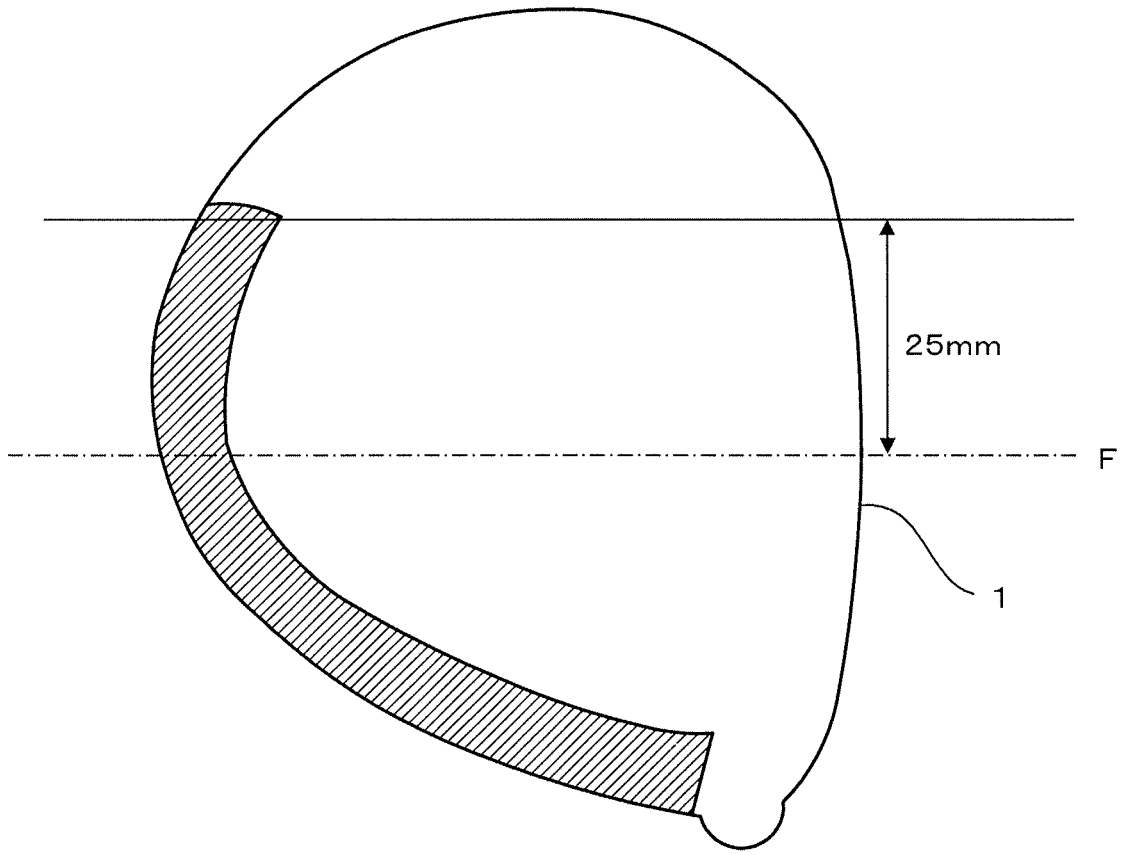
FIG. 6 is a diagram showing the head as viewed from a sole portion in order to describe weight distribution.

Due to providing the second regions 22 having a small thickness in the crown portion 2 as described above, the amount of weight that corresponds to the reduction in thickness compared to the first region 21 can be distributed to the side portion 4, for example. This enables increasing the moment of inertia of the head. This point will be described with reference to FIG. 6. FIG. 6 is a diagram showing the head as viewed from the sole portion side. The weight of the crown portion 2, which is reduced due to the second regions 22 as described above, is distributed to the region indicated by hatching in FIG. 6 on the back side of the side portion 4. For example, this region can be a range that extends along the boundary line with the crown portion 2 no more than 15 mm downward (toward the sole portion) from this boundary line, and furthermore extends to the heel side from a point 25 mm away to the toe side from a line F, which extends in the face-back direction and passes through the center of gravity of the head. Note that besides this region, the weight can be distributed to the sole portion 3 or the like as well.

The thickness of the regions 21 and 22 can be defined as follows. Specifically, in consideration of strength and rigidity, in the case where the head body is formed from a titanium alloy, a thickness D1 (first thickness) of the first region 21 can be set to 0.5 to 0.8 mm, and a thickness D2 (second thickness) of the second regions 22 can be set to 0.2 to 0.6 mm, for example, but the thicknesses differ according to the material that is used. Also, in the case where the head body is formed from stainless steel or maraging steel, the thickness D1 of the first region 21 can be set to 0.8 to 1.5 mm, and the thickness D2 of the second regions 22 can be set to 0.5 to 1.3 mm.

Reference sign S1 denotes the projected area of all of the second regions 22 in the plan view of the head shown in FIG. 4, reference sign S2 denotes the total area of the projected area of the crown portion and the projected area of the hosel portion, and it is preferable that the percentage R of the projected area S1 in the area S2 (=S1/S2) is 25% to 50%. If this percentage R is less than 25%, the effect of increasing the moment of inertia is difficult to obtain. For this reason, the percentage R is more preferably 28% or more, and particularly preferably 30% or more. On the other hand, if the percentage R is greater than 50%, castability decreases. For this reason, the percentage R is more preferably 45% or less, and particularly preferably 40% or less. For example, in the case of a driver, the area S2 is approximately 80 to 110 $cm^2$.

Also, as shown in FIG. 4, each second region 22 is formed such that its width increases as it extends from the origin S side to the peripheral portion 23 side, and in the present embodiment, each second region 22 is formed in roughly a fan shape, for example. Similarly, each portion of the first region 21 that is arranged between adjacent second regions 22 is configured such that its width W increases as it extends from the origin S side to the peripheral portion 23 side, and this portion is roughly fan-shaped. These portions of the first region 21 arranged between adjacent second regions 22 can be formed such that a width Wa of the end portion on the peripheral portion 23 side is 5 to 20 mm. Also, a width Wb of the end portion on the origin S side of these portions of the first region 21 is preferably 1 to 8 mm, more preferably 1.5 to 6 mm, and particularly preferably 2 to 5 mm. In particular, if the width Wa of the end portion on the peripheral portion 23 side is less than 5 mm, there is the risk of diminishing the effect of increasing the moment of inertia, and also the risk of poor flow of molten metal during later-described casting. For this reason, the width Wa of the end portion on the peripheral portion 23 side is more preferably 7 mm or more, and particularly preferably 9 mm or more. On the other hand, if the width Wa of the end portion on the peripheral portion 23 side is greater than 20 mm, reduction of the weight of the crown portion 2 is impaired, and there is the risk of limiting the effect of increasing the moment of inertia since it is not possible to ensure the weight that is to be distributed from the crown portion 2 to the side portion 4, for example. Accordingly, the width Wa of the end portion on the peripheral portion 23 side is more preferably 16 mm or less, and particularly preferably 12 mm or less. Note that the moment of inertia referred to here is the moment of inertia (horizontal moment of inertia) about the vertical axis passing through the center of gravity of the head. Also, the widths W of the portions of the first region 21 and the second regions 22 are basically values measured along a direction perpendicular to the direction extending from the origin S to the peripheral portion 23 side (line L in FIG. 4), and they are distances between adjacent regions in the end portion on the origin S side or the peripheral portion 23 side (e.g., Wa and Wb in FIG. 4).

Also, the peripheral portion 23 of the crown portion 2 is constituted by the first region 21. Accordingly, the edge of each of the second regions 22 on the peripheral portion 23 side is not directly connected to the side portion 4, but rather is separated from the side portion 4 by portions of the large-thickness first region 21. The width X of these portions of the first region 21 can be set to 1 to 30 mm, for example. If this width X is less than 1 mm, there is the risk of diminishing the effect of increasing the moment of inertia. Accordingly, this width X is more preferably 3 mm or more, and particularly preferably 5 mm or more. On the other hand, if this width X is greater than 30 mm, there is the risk of impairing the reduction of the weight of the crown portion 2. Accordingly, the width X is more preferably 20 mm or less, and particularly preferably 10 mm or less.

Figure 7A:
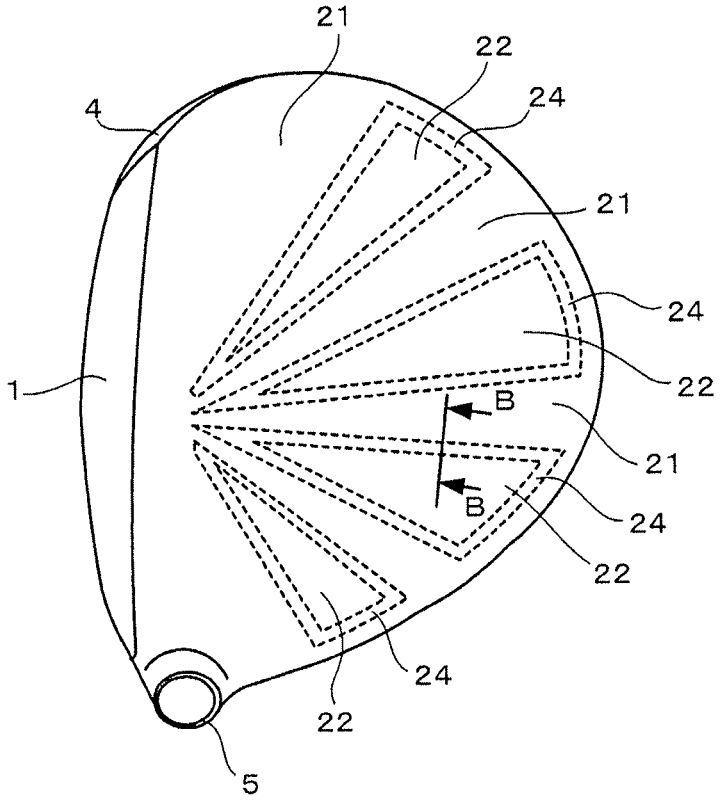
FIG. 7A is a plan view of a golf club head that has transition portions.
Figure 7B:
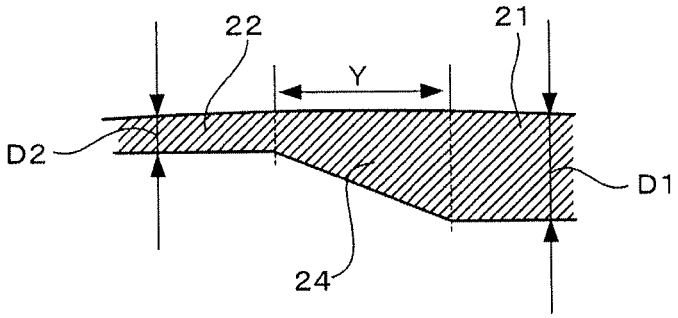
FIG. 7B is a cross-sectional view taken along B-B in FIG. 7A.

As shown in FIG. 5, level changes are formed in the inner wall surface of the head at the boundaries between the first region 21 and the second regions 22 due to the difference in thicknesses. To address this, transition portions 24 in which the thickness changes can be provided between the first region 21 and the second regions 22. This point will be described with reference to FIGS. 7A and 7B. FIG. 7A is a plan view of a golf club head that has transition portions, and FIG. 7B is a cross-sectional view taken along B-B in FIG. 7A. As shown in these figures, the transition portions 24 provided between the first region 21 and the second regions 22 are, in a cross-sectional view, regions in which the inner wall surface is inclined and the thickness gradually decreases from the first region 21 to the second region 22 in the planar direction. Due to providing these regions, the second regions 22 that readily vibrate when hitting a ball are reinforced by the transition portions 24, thus making it possible to prevent an increase in the length of impact reverberation. In view of this, the width of the transition portions 24 can be set to 0.5 to 10 mm, for example. Here, the width of the transition portions 24 can be adjusted by adjusting the area of the second regions 22. For example, in order to increase the width of the transition portions 24, the areas of the second regions 22 are reduced without changing the areas of the portions of the first region 21 between adjacent second regions 22. If the width Y of the transition portions 24 is less than 0.5 mm, there is the risk of the impact reverberation being too long. In view of this, the width of the transition portions 24 is more preferably 2.0 mm or more. On the other hand, if the width of the transition portions 24 is greater than 10 mm, the impact reverberation is too short, and there is a decrease in the size of the region having a small thickness, thus making it impossible to sufficiently increase the moment of inertia. In view of this, the width of the transition portions 24 is more preferably 6.0 mm or less, and particularly preferably 3.0 mm or less.

Figure 8:
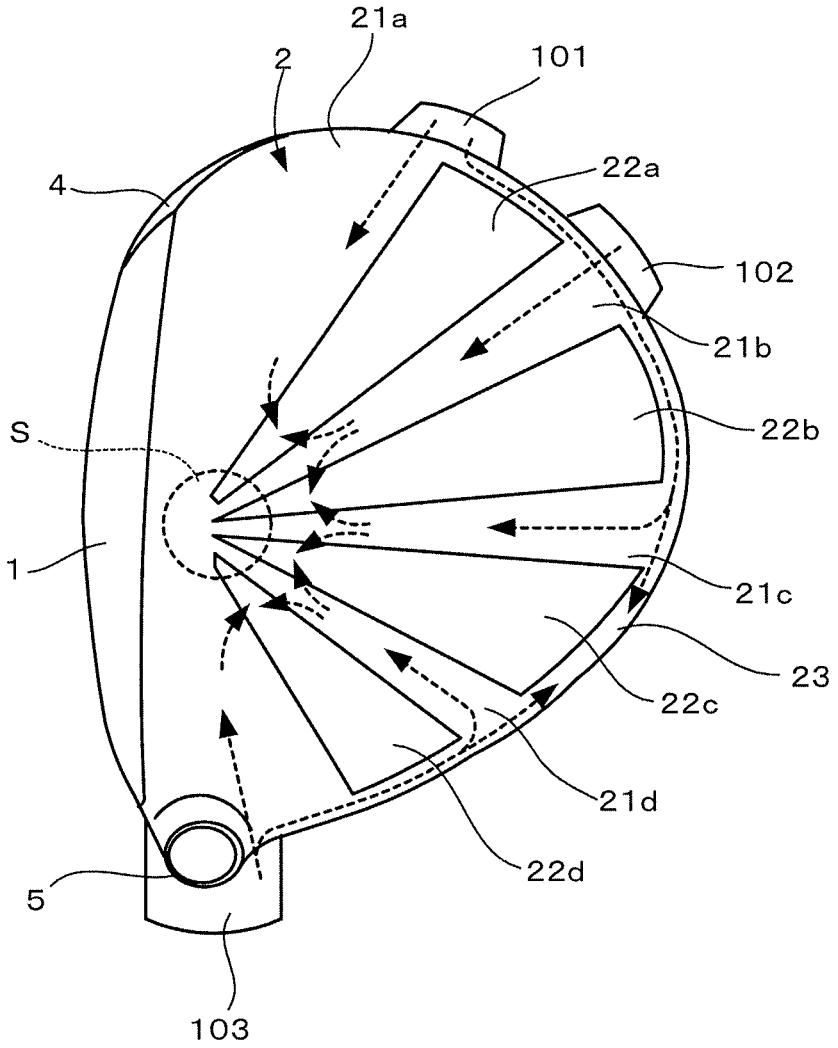
FIG. 8 is an inside view of the cavity of a mold for a head body.

The following describes an example of a method of manufacturing a golf club head configured as described above. The golf club head of the present embodiment is a hollow structure, and therefore can be manufactured by joining two or more members. Specifically, it can be manufactured by joining a head body, in which one or two or more openings in communication with the internal space are formed, with another member for blocking the opening. As described above, the head body includes at least the crown portion 2, and it can be manufactured by casting using a known lost-wax precision casting method, for example. This point will be described with reference to FIG. 8. FIG. 8 is an inside view of the cavity of a mold for the head body. Note that in order to facilitate the description, portions in FIG. 8 that correspond to portions of the golf club head shown in FIGS. 1 to 7 have been given the same reference signs in FIG. 8.

As shown in FIG. 8, this mold is provided with gates at three locations, namely first to third gates 101 to 103. Among these gates, the first and second gates 101 and 102 are provided at positions that oppose the peripheral portion 23 of the crown portion 2, and molten metal is poured through them toward the crown portion 2 from the peripheral portion 23. The first gate 101 is arranged so as to cover the boundary between a second region 22*a* arranged most toward the toe side and a first region portion 21*a* on the toe side that is adjacent to the second region 22*a*. The second gate 102 is provided so as to cover a first region portion 21*b* located between the second region 22*a* arranged most toward the toe side and a second region 22*b* arranged second from the toe side, as well as first region portion 21*c* located between second region 22*b* and second region 22*c*. Also, the third gate 103 is provided in the side portion 4 in the vicinity of the hosel portion 5 so as to cover first region portion 21*d* located between second region 22*c* and second region 22*d*.

When molten metal made of the above-described metal material is injected into the above-described mold through the first to third gates 101 to 103, the molten metal flows in the crown portion 2 in the following manner. First, since the first and second gates 101 and 102 oppose the peripheral portion 23 of the crown portion 2, that is to say, oppose the first region having a large thickness, molten metal easily flows through them. After flowing through the first and second gates 101 and 102, the molten metal flows along the peripheral portion 23 toward the hosel portion 5 side, while also heading toward the origin S side as it flows through the first region portion 21 on the toe side and the first region portions 21 arranged between adjacent second regions 22. As the first region portions 21 extend to the origin S side, their width decreases, and therefore pressure acting on the molten metal increases. For this reason, in order to release this pressure, the molten metal flows out of the first region portions 21 into the adjacent second regions 22. Specifically, this molten metal is gradually pushed from the first region portions 21 to the adjacent second regions 22 from the origin S side of the first region portions 21 toward the peripheral portion 23 of the crown portion 2. Also, the molten metal injected through the third gate 103 also similarly flows along the peripheral portion 23 toward the toe side, while also flowing into the first region 21 toward the face side. As the pressure rises, the molten metal flows from the face side of the first region 21 to the second regions 22. In this way, molten metal can be caused to sufficiently reach the small-thickness second regions 22 as well.

The above embodiment can obtain the following effects.

(1) In the crown portion 2, large-thickness first region portions 21 are arranged between adjacent small-thickness second regions 22, thus making it possible to suppress a reduction in mechanical strength caused by the reduction in thickness. Also, by adjusting the number of and positions of the second regions 22, a large-thickness first region portion 21 can be arranged in the central portion of the crown portion 2 that is subjected to high impact, which also has the advantage of making it possible to ensure strength for the head. Furthermore, since the first region portions 21 are distributed in a radiating fashion so as to extend from an origin on the face side toward the back side, impact force from hitting a ball can be allowed to escape in a radiating fashion toward the peripheral portion 23 of the crown portion 2, and this also makes it possible to suppress a reduction in mechanical strength.

(2) The first region portions 21 arranged between adjacent second regions 22 are configured such as to increase in width as they extend from the origin S side to the peripheral portion 23 side, thus making it possible to cause the weight distribution of the reduced-weight crown portion 2 to increase toward the peripheral portion 23. This enables increasing the moment of inertia about the vertical axis passing through the center of gravity of the head, thus making it possible to improve directionality when hitting a ball.

(3) Since multiple second regions 22 having a small thickness are provided in the crown portion 2, the weight of the crown portion 2 can be reduced. Also, the amount of weight corresponding to the reduction in thickness for weight reduction can be distributed to other portions of the head as described above. This enables improving the degree of freedom in head design. For example, if the above-described weight is distributed to the sole portion 3 of the club head, the center of gravity can be lowered, consequently making it possible to raise the launch angle. Alternatively, if the weight is distributed to the side portion 4, the moment of inertia about the vertical axis passing through the center of gravity of the head can be increased, thus making it possible to improve directionality when hitting a ball.

(4) When using casting to manufacture a head body that includes the above-described crown portion, the peripheral portion 23 of the crown portion 2 is constituted by the first region 21 that has a large thickness, thus making it easier for molten metal to be poured through these portions. Also, the molten metal flowing through the peripheral portion 23 flows around the crown portion 2 while also flowing through the large-thickness first region 21 toward the origin S side. The pressure acting on the molten metal flowing through the first region 21 increases as it approaches the face side, and therefore the molten metal flows into adjacent second regions 22 in order to release this pressure. Accordingly, molten metal can be caused to sufficiently reach the small-thickness second regions 22 as well, thus making it possible to prevent molding defects.

Although an embodiment of the present invention has been described above, the present invention is not limited to the above embodiment, and various modifications can be carried out without departing from the gist of the invention. The following are examples of modifications.

Although the second regions 22 are fan-shaped in the above embodiment, they do not need to be strictly fan-shaped, and they need only be shaped such that the width increases as they extend from the origin S side toward the peripheral portion 23 side. For example, the second regions 22 may be shaped so as to be curved overall due to the radial portions of the fan shape being formed by curved lines rather than straight lines. Accordingly, the first region portions 21 arranged between adjacent second regions 22 may also be shaped so as to extend in a curved manner from the origin S side toward the peripheral portion 23 side, for example. Also, the end portions of the second regions 22 on the face side do not need to have a sharp shape, and they can be formed so as to be arc-shaped or the like. Also, the width of the second regions 22 does not necessarily need to change, and as long as at least the width W of the first region portions 21 between adjacent second regions 22 increases toward the peripheral portion 23 side, the second regions 22 may have a constant width as they extend from the origin S side toward the peripheral portion 23 side. Also, there is no particular limit on the number of second regions 22.

Although the mold is provided with three gates in the above embodiment, there is no limitation to this. Specifically, it is sufficient that at least one of the gates is provided at a position that opposes the peripheral portion 23 of the crown portion 2 so as to enable molten metal to be poured into the peripheral portion 23 of the crown portion 2.

Although the head of the above embodiment is constituted by combining a head body that has at least the crown portion 2 with another portion, the present invention is also applicable to a head in which only the crown portion 2 is formed by a separate member. For example, in the case of constituting the head such that the head body includes a face portion, a side portion, a sole portion, and an opening for the crown portion, and fitting the crown portion into the opening, the above-described first and second regions can be formed in the crown portion.

WORKING EXAMPLES

The following describes working examples of the present invention. Note that the present invention is not limited to the following working examples.

Golf club heads according to eight types of working examples having various modes of crown portions and according to five types of comparative examples were created. These golf club heads were manufactured by constituting the face portion by a separate member and joining it to the head body. The face portion was formed by performing press processing on "Super TI-X51AF" (manufactured by Kobe Steel, Ltd.), which is a rolled material. The head body was then formed by performing lost-wax precision casting using molten metal made of a titanium alloy (Ti-8Al-2V). Working Examples 1 to 8 and Comparative Examples 1 to 5 were created in the modes indicated in Table 1 below. Note that in all of the working examples and the comparative examples, the head weight was 195 g and the head volume was 460 cc. Accordingly, in the case providing small-thickness second regions in the crown portion, the overall weight of the head is kept the same due to the amount of weight corresponding to the reduction in thickness being distributed to the side portion as shown in FIG. 6.

TABLE 1

| | WE 1 | WE 2 | WE 3 | WE 4 | WE 5 | WE 6 | WE 7 | WE 8 | CE 1 | CE 2 | CE 3 | CE 4 | CE 5 |
|---|---|---|---|---|---|---|---|---|---|---|---|---|---|
| 1st region widthWa (mm) | 10.0 | 4.0 | 25.0 | 10.0 | 10.0 | 10.0 | 10.0 | 10.0 | 3.0 | 3.0 | 10.0 | — | — |
| 1st region widthWb (mm) | 3.0 | 0.8 | 9.0 | 3.0 | 3.0 | 3.0 | 3.0 | 3.0 | 3.0 | 3.0 | 3.0 | — | — |
| 1st region thickness (mm) | 0.6 | 0.6 | 0.6 | 0.6 | 0.6 | 0.6 | 0.6 | 0.6 | 0.6 | 0.6 | 0.6 | 0.4 | 0.6 |
| 2nd region thickness (mm) | 0.4 | 0.4 | 0.4 | 0.4 | 0.4 | 0.4 | 0.4 | 0.4 | 0.4 | 0.4 | 0.4 | 0.4 | 0.6 |
| 2nd region area ($mm^2$) | 3120 | 4099 | 926 | 4214 | 1176 | 192 | 4540 | 50 | 3120 | 3120 | 3855 | 11146 | 0 |
| Peripheral portion width X | 5.0 | 5.0 | 5.0 | 5.0 | 5.0 | 5.0 | 5.0 | 5.0 | 5.0 | 5.0 | 0 | — | — |

TABLE 1-continued

| | WE 1 | WE 2 | WE 3 | WE 4 | WE 5 | WE 6 | WE 7 | WE 8 | CE 1 | CE 2 | CE 3 | CE 4 | CE 5 |
|---|---|---|---|---|---|---|---|---|---|---|---|---|---|
| Transition portion width Y | 2.0 | 2.0 | 2.0 | 0.5 | 6.0 | 10.0 | 0 | 12.0 | 2.0 | 2.0 | 2.0 | — | — |

Working Examples 1 to 8 and Comparative Examples 1 to 5 have the following characteristics. In the figures used in the following descriptions, the second regions are enclosed in dashed lines. Also, the transition portions are sometimes omitted.

(1) Working Example 1

As shown in FIG. 7, the crown portion of Working Example 1 has four fan-shaped second regions. Also, the transition portion is formed between the first region and the second regions.

(2) Working Example 2

Figure 9:
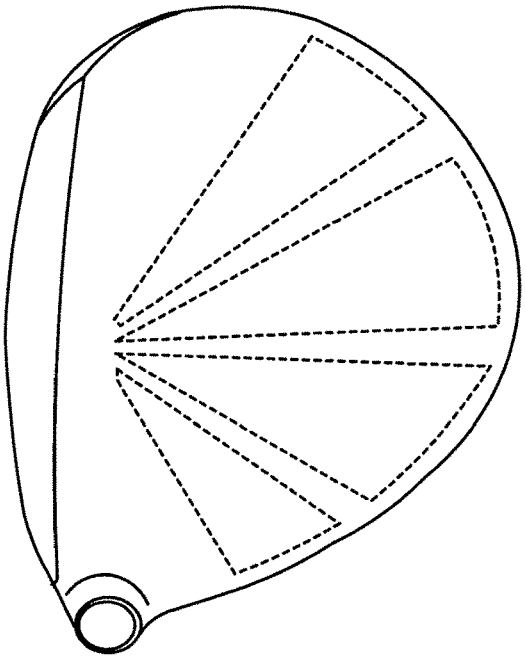
FIG. 9 is a plan view of a golf club head according to Working Example 2.

The crown portion of Working Example 2 is the same as that of Working Example 1 with the exception that, as shown in FIG. 9, the width of the first region portions arranged between the second regions is smaller than in Working Example 1.

(3) Working Example 3

Figure 10:
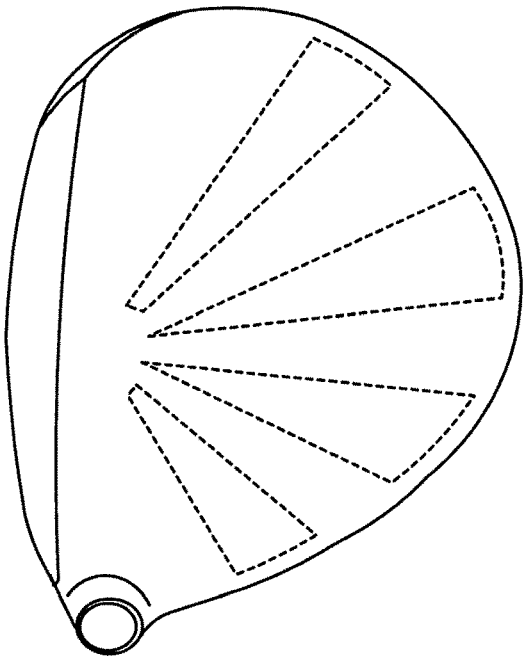
FIG. 10 is a plan view of a golf club head according to Working Example 3.

The crown portion of Working Example 3 is the same as that of Working Example 1 with the exception that, as shown in FIG. 10, the width of the first region portions arranged between the second regions is larger than in Working Example 1.

(4) Working Example 4

The crown portion of Working Example 4 is the same as that in Working Example 1 with the exception that the width of the transition portions is smaller than in Working Example 1.

(5) Working Example 5

The crown portion of Working Example 5 is the same as that in Working Example 1 with the exception that the width of the transition portions is larger than in Working Example 1.

(6) Working Example 6

The crown portion of Working Example 6 is the same as that in Working Example 5 with the exception that the width of the transition portions is larger than in Working Example 5.

(7) Working Example 7

The crown portion of Working Example 7 is the same as that in Working Example 1 with the exception that the transition portion is not provided.

(8) Working Example 8

The crown portion of Working Example 8 is the same as that in Working Example 6 with the exception that the width of the transition portions is larger than in Working Example 6.

(9) Comparative Example 1

Figure 11:
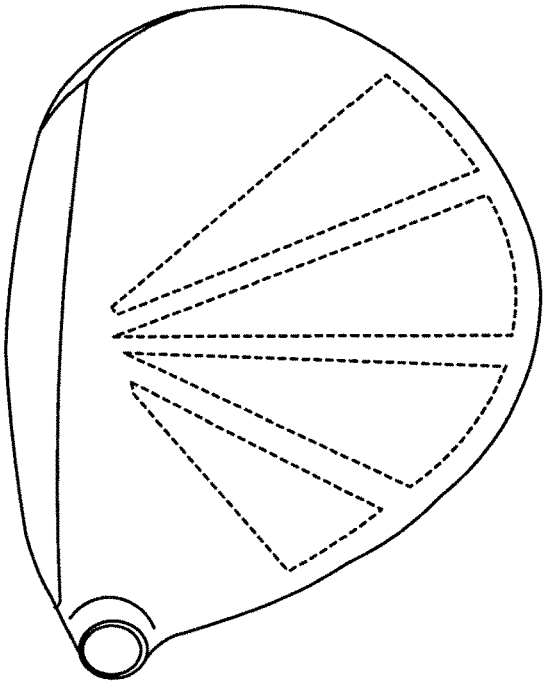
FIG. 11 is a plan view of a golf club head according to Comparative Example 1.

As shown in FIG. 11, the crown portion of Comparative Example 1 is provided with multiple second regions that are fan-shaped and distributed in a radiating fashion, but the width of the first region portions arranged between adjacent second regions is constant from the origin toward the peripheral portion. More specifically, the area of the second regions is the same as in Working Example 1, but the width of the first region portions is constant.

(10) Comparative Example 2

Figure 12:
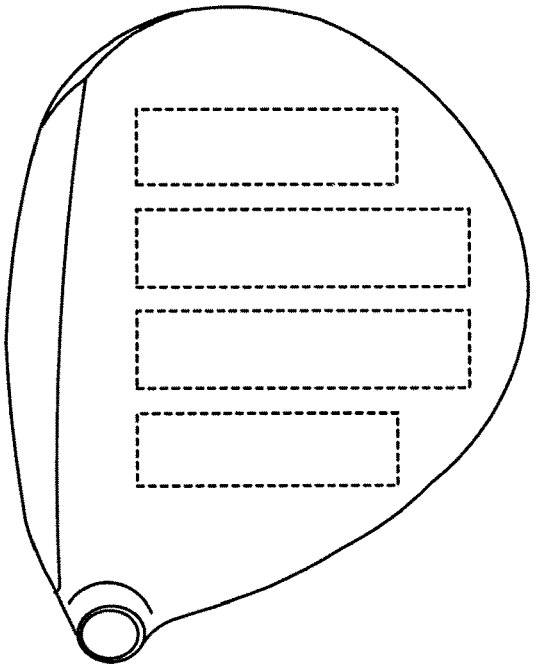
FIG. 12 is a plan view of a golf club head according to Comparative Example 2.

As shown in FIG. 12, the crown portion of Comparative Example 2 has multiple second regions that have a small thickness, but these second regions are all rectangular, aligned in parallel from the toe side to the heel side, and extend from the face portion side toward the back portion side. Accordingly, the first region portions between the second regions are also rectangular, and extend with a constant width from the face portion side to the back portion side.

(11) Comparative Example 3

Figure 13:
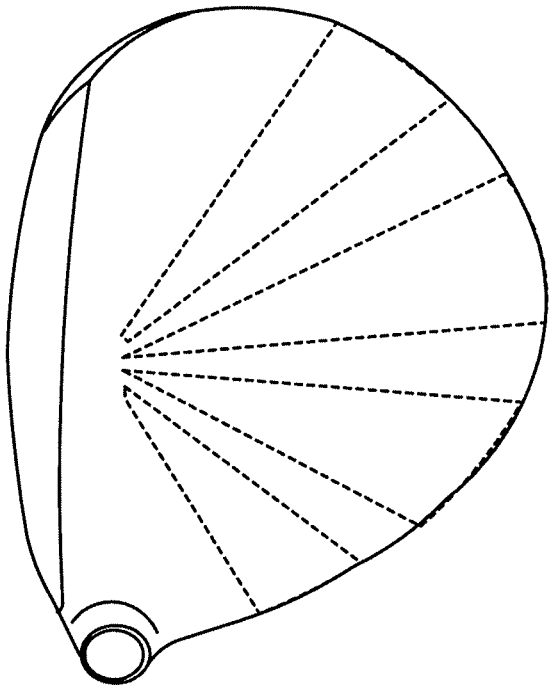
FIG. 13 is a plan view of a golf club head according to Comparative Example 3.

The crown portion of Comparative Example 3 is the same as that in Working Example 1 with the exception of not having the peripheral portion. Specifically, as shown in FIG. 13, the second regions of Comparative Example 3 are directly connected to the boundary with the side portion instead of having the first region therebetween.

(12) Comparative Example 4

The crown portion of Comparative Example 4 is the same as that in Working Example 1 with the exception that the second regions are not provided, and the thickness is constant. The thickness of the crown portion is the same as that of the second regions in Working Example 1.

(13) Comparative Example 5

The crown portion of Comparative Example 5 is the same as that in Working Example 1 with the exception that the second regions are not provided, and the thickness is constant. The thickness of the crown portion is the same as that of the first region in Working Example 1.

The following points were evaluated in the above-described working examples and comparative examples.

(a) Moment of Inertia

Each head was placed in the reference state, and the moment of inertia (horizontal moment of inertia) about the vertical axis passing through the center of gravity of the head was measured. The measurement was performed using the Moment of Inertia Measuring Instrument with model number 005-002 from Inertia Dynamics, Inc. The higher the value is, the smaller the amount of head wobble during a missed shot, which is more favorable.

(b) Length of Impact Reverberation

The length of impact reverberation was subjected to sensory evaluation when ten testers perform test hits. The testers were average golfers (handicap of 15 to 25) having a head speed of 40 m/s. The same FRP shaft (MP 700 Flex R made by Dunlop Sports Co., Ltd.) was attached to the heads of the above working examples and comparative examples to create 45.5 inch wood golf clubs, and they were used to perform test hits with two-piece golf balls (DDH Tour Special made by Dunlop Sports Co., Ltd.). Ten levels were used in the evaluation, and the sensory test was performed with level 6 being assumed to be the most appropriate reverberation length, and the level value rising as the reverberation length increased.

(c) Castability

The molded head bodies were visually checked, and the head was determined to be a defective product if the molten metal did not sufficiently reach any portion. 200 head bodies were created, and the following grades were given: A if the defect percentage was 0% to 2%, B if 2% to 6%, C if 6% to 10%, D if 10% to 20%, and E if 20% or more.

(d) Durability Evaluation

Durability was evaluated using an impact robot (Shot Robo-3DX made by Miyamae Co., Ltd.). Two-piece golf balls (DDH Tour Special made by Dunlop Sports Co., Ltd.) were hit with the center of the face at a head speed of 50 m/s, and the following grades were given: A if the number of test hits performed before the head body cracked was 10,000 or more, B if 8,000 to 10,000, C if 6,000 to 8,000, D if 4,000 to 6,000, and E if less than 4,000.

The results were as follows.

TABLE 2

| | WE 1 | WE 2 | WE 3 | WE 4 | WE 5 | WE 6 | WE 7 | WE 8 | CE 1 | CE 2 | CE 3 | CE 4 | CE 5 |
|---|---|---|---|---|---|---|---|---|---|---|---|---|---|
| Moment of inertia ($g \cdot cm^2$) | 4900 | 5000 | 4800 | 5100 | 4860 | 4720 | 5120 | 4700 | 4830 | 4820 | 4970 | 5200 | 4600 |
| Impact reverberation length | 6.1 | 7.2 | 4.9 | 7.5 | 5.5 | 5.0 | 8.8 | 4.3 | 6.0 | 6.4 | 7.0 | 9.0 | 4.1 |
| Castability | A | C | B | A | A | A | B | A | D | E | D | E | A |
| Durability | A | B | A | A | A | A | B | A | D | D | D | E | A |

The following observations were made regarding the working examples and comparative examples. First, a comparison of Working Example 1 and Comparative Examples 1 and 2, in which the area of the second regions is the same, shows that the moment of inertia is higher in Working Example 1 than in Comparative Examples 1 and 2. This is thought to be due to the fact that in Working Example 1, the large-thickness first region portions extend in a radiating fashion from the origin toward the peripheral portion, and the width of the first region portions also increases as they extend from the origin toward the peripheral portion. Also, due to this configuration, durability is more favorable in Working Example 1 than in Comparative Examples 1 and 2. In other words, this is thought to be due to the fact that the end portions of the first region portions in the crown portion can be grouped close together at positions in the vicinity of the impact point on the face, and the width of the first region portions can be increased at in the peripheral portion of the crown portion. The other working examples also had more favorable durability than Comparative Examples 1 to 4 for similar reasons or due to having a thick peripheral portion. Note that although Comparative Example 5 has favorable durability, the crown portion is formed with only thick portions, and the amount of weight corresponding to the reduction in thickness of the crown portion is not distributed to the side portions as it is in the working examples, and therefore the moment of inertia is smaller than in all of the working examples. Furthermore, since the width of the transition portions is appropriate in Working Examples 1 to 6, the evaluation of impact reverberation length is comparatively close to 6.

Also, regarding castability, the width of the first region portions arranged between second regions is constant in Comparative Examples 1 and 2, and therefore pressure does not readily act on the molten metal as it flows through these regions, and thus the molten metal does not readily flow to the second regions. It is thought that molding defects often occur for this reason. In Comparative Example 3, the first region portions having a large thickness are not formed in the peripheral portion of the crown portion, and therefore the molten metal does not readily flow to the crown portion, and it is though that molding defects often occur for this reason. In Comparative Example 4, the thickness of the crown portion is small, and therefore the molten metal does not readily flow to the crown portion, and furthermore the durability is low.

The invention claimed is:

1. A golf club head that, when oriented in a reference state, comprises:

a face portion;

a rear portion opposite the face portion;

a heel portion;

a toe portion opposite the heel portion;

a hosel portion;

a sole portion; and a crown portion opposite the sole portion, the crown portion including:

a plurality of reduced thickness regions spaced apart from each other thereby defining one or more thickened elongate regions therebetween, each thickened elongate region having an average thickness greater than the average thickness of the reduced thickness regions, the plurality of reduced thickness regions having, in a top plan view, a total projected surface area S1; and a transition region between each adjacent reduced thickness region and the one or more thickened elongate regions, the transition region having a width no less than 0.5 mm and no greater than 10.0 mm, wherein the crown portion and the hosel portion, in the top plan view, have a combined projected surface area S2 such that S1 is no more than 50% of S2, and wherein the crown portion is integrally formed with the reduced thickness regions by investment casting, wherein the plurality of reduced thickness regions includes at least three reduced thickness regions that are oriented in a fan-like pattern such that a width of each of the three reduced thickness region generally increases in a front to rear direction, wherein the crown portion includes a face to rear length H; an origin located rearwardly from the face portion by a distance not more than 25% of length H; and a peripheral portion, and wherein the at least three reduced thickness regions extend from the origin toward the peripheral portion of the crown portion, and are all arranged backward of the origin, such that a shortest distance between the at least three reduced thickness regions and the face portion is no less than said distance between the origin and the face portion.

2. The golf club head of claim 1, wherein the transition region has a width no less than 2.0 mm and no more than 6.0 mm.

3. The golf club head of claim 1, wherein the crown thickness increases gradually within the transition region from each reduced thickness region to an adjacent thickened elongate region.

4. The golf club head of claim 1, wherein S1 is no less than 25% of S2 and no more than 45% of S2.

5. The golf club head of claim 1, wherein S2 is approximately 80 $cm^2$ to 110 $cm^2$.

6. The golf club head of claim 1, wherein the crown portion comprises a titanium alloy.

7. The golf club head of claim 6, wherein the face portion comprises a material different from crown portion.

* * * * *